US008397336B2

(12) United States Patent
Park

(10) Patent No.: US 8,397,336 B2
(45) Date of Patent: Mar. 19, 2013

(54) HAIRBRUSH

(75) Inventor: Young-soo Park, Tokyo (JP)

(73) Assignee: Park Way Co., Ltd, Tokyo (JP)

( * ) Notice: Subject to any disclaimer, the term of this patent is extended or adjusted under 35 U.S.C. 154(b) by 179 days.

(21) Appl. No.: 12/667,125

(22) PCT Filed: Jun. 23, 2008

(86) PCT No.: PCT/JP2008/061419

§ 371 (c)(1),
(2), (4) Date: Dec. 29, 2009

(87) PCT Pub. No.: WO2009/004945

PCT Pub. Date: Jan. 8, 2009

(65) Prior Publication Data

US 2011/0239390 A1 Oct. 6, 2011

(30) Foreign Application Priority Data

Jun. 29, 2007 (JP) ..... 2007-171890

(51) Int. Cl.
*A46B 15/00* (2006.01)

(52) U.S. Cl. ..... 15/186; 15/160

(58) Field of Classification Search ..... 15/22.1; 132/120; *A45D 20/52; A45B 11/00, 15/00, A45B 9/00*

See application file for complete search history.

(56) References Cited

U.S. PATENT DOCUMENTS

| | | | | |
|---|---|---|---|---|
| 2,633,591 | A * | 4/1953 | Servilla | 15/160 |
| 3,968,950 | A * | 7/1976 | Gallo | 248/688 |
| 4,500,939 | A | 2/1985 | Gueret | |
| 6,341,611 | B1 * | 1/2002 | Nakamura | 132/120 |

FOREIGN PATENT DOCUMENTS

| | | |
|---|---|---|
| JP | 58-185113 | 10/1983 |
| JP | 60-63238 | 5/1985 |

(Continued)

OTHER PUBLICATIONS

International Search Report for PCT/JP2008/061419 dated Aug. 12, 2008.

(Continued)

*Primary Examiner* — Monica Carter
*Assistant Examiner* — Stephanie N Berry
(74) *Attorney, Agent, or Firm* — Turocy & Watson, LLP

(57) ABSTRACT

A hairbrush in which air blown from a hair dryer to the rear face side of the hairbrush is smoothly guided to through-holes in the hairbrush to send the air to the front face side. In the hairbrush (1), divergent projections (4*a*-4*g*) are formed on a rear face (2*a*) of a base section (2) and through-holes (8*a*-8*f*) are respectively formed in depressions (3*a*-3*f*) located between the projections. A cushion member (5) of a brush section (9) is fixed to the front face (2*e*) side of the base section (2) of the hairbrush (1), and bristles (6) are embedded in the cushion member (5) through which holes (5*a*) are formed. Air blown from the hair dryer to the rear face (2*a*) side of the hair brush (1) is guided by the projections (4*a*-4*g*) to the depressions (3*a*-3*f*) located between the projections and enters the through-holes (8*a*-8*f*). The air passed through the through-holes (8*a*-8*f*) passes through the holes (5*a*) in the cushion member (5) and sent to the front face side of the hairbrush (1).

20 Claims, 17 Drawing Sheets

FOREIGN PATENT DOCUMENTS

| | | | |
|---|---|---|---|
| JP | 63-163635 | | 10/1988 |
| JP | 5-1316 | | 1/1993 |
| JP | 2004-008669 | | 1/2004 |
| JP | 2004008669 A | * | 1/2004 |
| JP | 3121819 | | 5/2006 |
| JP | 2006-166991 | | 6/2006 |
| JP | 1297685 | * | 4/2007 |

OTHER PUBLICATIONS

International Preliminary Report on Patentability for PCT/JP2008/061419.

* cited by examiner (a)

(b)

HAIRBRUSH

TECHNICAL FIELD

The present invention relates to a hairbrush where in a case of using a hairbrush and a hair dryer at the same time, air from the hair dryer is smoothly fed to a brush side passing through through-holes formed in the hairbrush.

BACKGROUND

Conventionally, there have been hairbrushes in which through-holes are provided in the hairbrush per se to pass air from the hair dryer in order to send air from the hair dryer to a portion of the head hair covered by the hairbrush in a case of using the hairbrush and the hair dryer at the same time to brush the hair or to style the hair.

For example, Patent Document 1 below discloses a hairbrush having a hair implant base part of bristle (brush hair) of a brush base body formed with a translucent window (through-hole) to pass the air of the hair dryer through. Further, Patent Document 2 discloses a hair styling brush of a configuration where a bristle-arrayed body with bristles being arrayed and fixed thereon is fitted to a handle part, and the bristle-arrayed body and the handle part are respectively formed with through-holes. Further, Patent Document 3 discloses a hairbrush of a configuration where formed are through-holes for passing the air from the hair dryer from the rear face side of a brush base body to the front face side of a brush member.

Incidentally, Patent Document 4 below discloses a hairbrush of a configuration where a pin-protruded body with plural pins being provided in a protruded condition is attached to a brush base body, which is a separated member. The hairbrush has a brush base body a rear face of which is formed with a plurality of projections and depressions and which is provided with through-holes. However, an opening of the through-hole on the side of the pin-protruded body is blocked by an attached face of the pin-protruded body; therefore, the through-holes of the hairbrush according to Patent Document 4 is in a state of not being able to pass the air of the hair dryer through.

Patent Document 1: Japanese Unexamined Patent Application Publication No. H07(1995)-289348;

Patent Document 2: Japanese Unexamined Patent Application Publication No. 2000-157337;

Patent Document 3: Japanese Unexamined Patent Application Publication No. 2004-8669; and Patent Document 4: Japanese Design Registration Publication No. 1297685.

SUMMARY

Technical Problem

The hairbrushes according to Patent Documents 1 to 3 all have through-holes; however, the rear face catching the air of the hair dryer is a flat surface with no projection and depression, and the hair dryer air blown to the rear face is not led to the through-holes. Thus, there has been a problem in which the blown air to the hairbrush flows in a direction other than the through-holes, and an amount of the blown air passing through the through-holes is lacking. Therefore, there is a situation when brushing hair or styling hair with the hairbrush and using the hair dryer at the same time, a sufficient amount of air cannot be sent to a portion of the head hair covered by the hairbrush in use, and in some cases, it is difficult to dry the head hair fast or achieve a desired styling.

Solution to Problem

The present invention is made in consideration of such problems, and has an object to provide a hairbrush in which air from a hair dryer is smoothly guided to through-holes to send enough amount of air to a portion of head hair covered by the hairbrush.

A hairbrush according to an aspect of the invention includes a handle, a base part provided at an end of the handle, and a brush part provided on a face of a first side of the base part, a plurality of projections of a base-diverging shape are formed on a face of a second side that is opposite from the first side, and at least one through-hole is formed so as to penetrate the base part. The through-hole is opened between opposing slope faces of the adjacent projections of the plurality of projections.

In the aspect of the invention, the adjacent projections in the plurality of base-diverging projections have the slope faces opposite to each other between which an opening of the through-hole is formed. Air from a hair dryer blown to the base part face on the second side thereof first flows, owing to the plural base-diverging projections, between the projections. In addition, the air flown between the projections proceeds along the slope faces of the opposite projections, and enters the through-hole opened between both slope faces. Therefore, the air of the hair dryer can be effectively guided to the through-hole to increase the amount of air passing through the through-hole compared with the hairbrush provided with the through-hole of related art.

In the hairbrush according to the aspect of the invention, the through-hole may be formed such that a hole size thereof becomes smaller from the second side towards the first side.

In the aspect of the invention, as the through-hole is formed such that the hole size becomes smaller from the second side towards the first side, the air of the hair dryer is made to be taken smoothly into the through-hole with the opening of larger size holes on the second side, and the taken air of the hair dryer is made to be flowed out strongly from the first side where the hole size becomes gradually smaller. Therefore, the air of the hair dryer can be sent to a portion of head hair covered by the hairbrush with enough amounts and strong flow of air.

In the hairbrush according to the aspect of the invention, the projections may be formed continuously in one direction on the face of the second side, and a plurality of through-holes are formed at a predetermined interval in a direction parallel to the direction of the projections continuously arranged.

In the aspect of the invention, the projections are formed continuously in one direction; thus, the through-holes can be formed regularly at a predetermined interval in plural numbers in the direction of the projections continuously formed, and through the plural through-holes arrayed regularly the air of the hair dryer can be sent in large amounts to the portion of the head hair covered by the hairbrush.

In the hairbrush according to the aspect of the invention, the plurality of projections continuously formed in the one direction may be arranged in parallel to each other.

In the aspect of the invention, the plural projections are arranged in a parallel manner, and due to such an arrangement, the through-holes provided between the projections are arranged in a lattice shape on the entire surface of the base part on the second side thereof. Therefore, the total area of the opening of the through-holes can be spread. As a result, the air of the hair dryer can pass through many through-holes in large amounts, and large amounts of air can be sent to the portion of the head hair covered by the hairbrush in use.

In the hairbrush according to the aspect of the invention, the projections may include at least four projections. An interval between the projections on the center side may be made larger than an interval between the projections on the end sides in a direction perpendicular to the one direction, and each size of the through-holes located on the center side may be made larger than each size of the through-holes located on the end sides.

In the aspect of the invention, with respect to the plural projections arranged in a line in a parallel manner, the interval between the projections on the center side among those arranged in a parallel manner is made larger than on the end sides, and the size of the through-holes provided between the projections on the center side is made larger than of the through-holes provided between the projections on the end sides. Therefore, the air of the hair dryer blown to the vicinity of the center side in the direction of the parallel manner arrangement can be effectively passed through. That is, when using the hairbrush and the hair dryer at the same time, generally, the hair dryer is often used such that the air of the hair dryer is blown to the vicinity of the center side of the hairbrush rather than the end sides thereof, and thus, with a configuration of the projections and the through-holes being made as described above, the air of the hair dryer can be effectively guided to the portion of the head hair covered by the hairbrush in accordance with the general usage of the hair dryer.

In the hairbrush according to the aspect of the invention, a peripheral shape of the base part may have an ellipsoidal shape on the face of the second side, and a hole shape of the through-hole may be made ellipsoidal. A longitudinal direction of the base part may be coincided with the longitudinal direction of the hole shape.

In the aspect of the invention, the peripheral shape of the base part and the hole shape of the through-holes are both made ellipsoidal, and the longitudinal directions of both are coincided with each other. Therefore, the plural through-holes can be arranged in high density, and the total area of the openings of the plural through-holes can be largely secured to send larger amounts of air of the hair dryer to the portion of the head hair covered by the hairbrush.

In the hairbrush according to the aspect of the invention, the brush part may include a brush base body having a plurality of bristles or brush pins, and at least one hole may be formed so as to penetrate the brush base body.

In the aspect of the invention, even when the hairbrush has a configuration where there is provided the brush base body having the plurality of bristles or brush pins as the brush part on the first side of the base part, the holes are also provided to the brush base body. Accordingly, the air of the hair dryer passed through the through-holes of the base part also passes through the holes of the brush base body to reach the portion of the head hair covered by the hairbrush. Therefore, the air of the hair dryer can be smoothly passed through inside the hairbrush, as for the hairbrush of the configuration having the brush base body separate from the base part, as well as the hairbrush of the configuration has the brush part provided directly to the base part.

In the hairbrush according to the aspect of the invention, the brush pins may be embedded in the brush base body, and may be formed with a pin bore so as to penetrate therethrough in a pin axis direction. A portion of the brush base body embedded with the brush pin may have a communicating hole formed which communicates with the pin bore.

In the aspect of the invention, the brush pin embedded in the brush base body has the pin bore formed through, and the portion of the brush base body embedded with the brush pin has the communicating hole formed which communicates with the pin bore. Accordingly, the air of the hair dryer passed through the base part goes from the communicating hole of the brush base body to the pin bore to be blown from the brush pin. Therefore, the air of the hair dryer blown from a pin tip of the brush pin can be used for a cosmetic technique relating to brushing or styling of hair, and the scalp of a user can be stimulated in a pinpoint manner, and so on.

In the hairbrush according to the aspect of the invention, an air shielding part may be protruded either on a portion of the end of the handle or on a portion of the base part on the side coupled with the handle. The air shielding part is formed so as to prevent wind blown to the face of the second side of the base part is prevented from flowing towards the handle.

In the aspect of the invention, since the air of the hair dryer blown to the base part face on the second side thereof is prevented from flowing to the handle due to the air shielding part, even if air blown out of the hair dryer is hot air, a hand of a user gripping the handle of the hairbrush is not exposed to the hot air, enabling the user to concentrate on using the hairbrush without caring about the hot air of the hair dryer.

Advantageous Effects of Invention

In the aspect of the invention, since the through-hole is formed so as to be opened between the base-diverging plural projections, the air of the hair dryer blown to the base part face on the second side thereof can be smoothly guided to the through-hole owing to the slope faces of both side projections.

Further, in the aspect of the invention, since the through-hole is formed so that the hole size decreases from the second side towards the first side of the base part, the air of the hair dryer can be taken from the opening of larger hole size on the second side into the through-hole in a large amount, and the air of the hair dryer taken can be blown out strongly from the first side of the smaller hole size.

Additionally, in the aspect of the invention, since the projection is formed in a shape of continuing in one direction, the through-hole can be formed regularly in the continuing direction of the projections at a predetermined interval in plural numbers, and the air of the hair dryer can be sent to the side of the brush part of the hairbrush in large amounts through the plural through-holes arranged regularly.

Further, in the aspect of the invention, since the plural projections are arranged in a parallel manner, arrangement of the through-holes provided between the projections can be formed in a lattice shape on the entire surface of the base part on the second side thereof, and the total area of the openings of the through-holes arranged can be increased to allow the air of the hair dryer to pass through the plural through-holes in large amounts.

In the aspect of the invention, with respect to the plural projections arranged in a line in a parallel manner, an interval between the projections on the center side among those arranged in a parallel manner is made larger than on the end sides, and the size of the through-hole provided between the projections on the center side is made larger than of the through-holes provided between the projections on the end sides; the air of the hair dryer blown to the vicinity of the center side in the direction of the parallel manner arrangement can be effectively passed through in accordance with the actual usage state of the hairbrush and the hair dryer.

Further, in the aspect of the invention, the peripheral shape of the base part and the hole shape of the through-hole are both made ellipsoidal, and longitudinal directions of both are coincided with each other, the plural through-holes can be arranged in a high density, and the total area of the openings of the plural through-holes can be largely secured to send a larger amount of air from the hair dryer to the brush part side of the hairbrush.

In the aspect of the invention, even if the hairbrush has a configuration where there is provided the brush base body having the plural bristles or brush pins as the brush part on the first side of the base part, the holes are also provided to the brush base body. Accordingly, the air of the hair dryer passed through the through-holes of the base part can be sent through the hole part of the brush base body to the portion of the head hair covered by the hairbrush.

Additionally, in the aspect of the invention, since the brush pin embedded in the brush base body has the pin bore formed therethrough, and the portion of the brush base body embedded with the brush pin has the communicating hole formed which communicates with the pin bore, the air of the hair dryer can be blown from the brush pin.

In the aspect of the invention, since the air of the hair dryer blown to the base part face on the second side thereof is blocked with the air shielding part protruded, even if hot air is blown from the hair dryer, the user's hand gripping the handle is not exposed to the hot air from the hair dryer, allowing provision of a situation where the user is likely to concentrate on using the hairbrush.

REFERENCE SIGNS LIST

Figure 1:
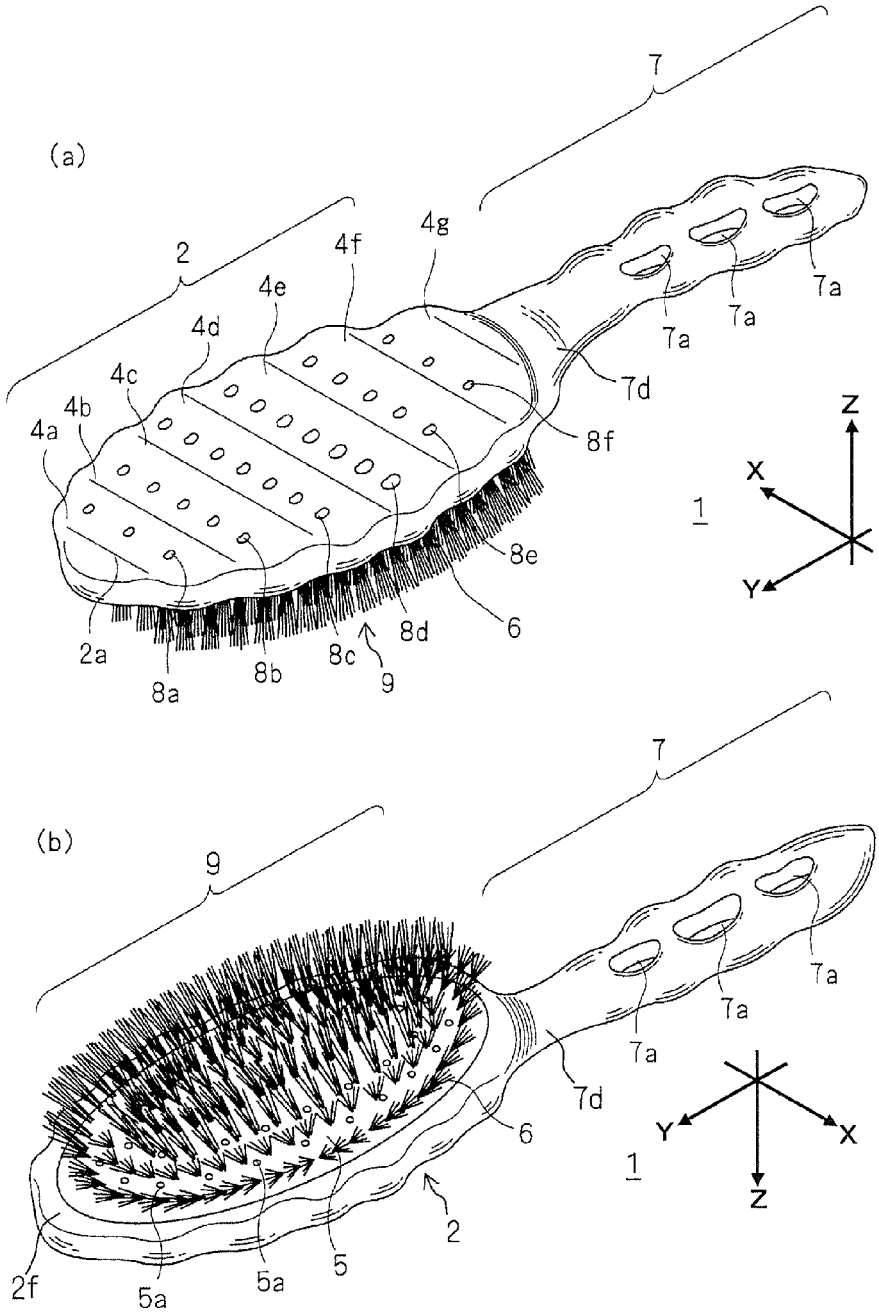
FIG. 1(*a*) is a perspective view seen from a rear face side of a hairbrush according to Embodiment 1 of the invention, and FIG. 1(*b*) is a perspective view seen from a front face side.

1 hairbrush
2 base part
4*a* to 4*g* protrusion
4*d*-1, 4*e*-1 slope face
5 cushion member
5*a* hole
6 bristle
7 handle
8*a* to 8*f* through-hole
9 brush part
33, 43 shielding part
93, 93' brush pin
93*a*, 93*a'* pin bore
94*b* communicating hole

DESCRIPTION OF EMBODIMENTS

Embodiment 1

FIG. 1(*a*) is a perspective view seen from a rear face side of a hairbrush 1 according to Embodiment 1 of the invention, and FIG. 1(*b*) is a perspective view seen from the front face side. The hairbrush 1 of this embodiment is a brush suitable for use with a hair dryer at the same time, and is characterized in that air from the hair dryer is guided smoothly to through-holes 8*a* to 8*f* formed with the hairbrush 1, and the air of the hair dryer can be sent effectively to a portion of the head hair covered by the hairbrush 1 in use.

The hairbrush 1 has a configuration where an end 7*d* of a handle 7 is coupled to a base part 2 of an approximately ellipsoidal shape. On a face of the front face side of the base part 2 (corresponding to the face of a first side), a brush part 9 having a number of bristle 6 is fitted and fixed. The handle 7 and the base part 2 are molded integrally with a synthetic resin, and a member forming the brush part 9 is a separated member from the handle 7 and the base part 2. Hereinafter, individual parts of the hairbrush 1 are described in detail. Note that the direction of the X-axis shown in FIGS. 1(*a*) and 1(*b*) coincides with the width direction of the hairbrush 1, and the direction of the Y-axis perpendicular to the X-axis coincides with the longitudinal direction of the hairbrush 1 (identical to the longitudinal direction of the handle 7), and the direction of the Z-axis perpendicular to both the X-axis and Y-axis coincides with the direction of the thickness of the hairbrush 1 (hereinafter, the same applies to other figures).

Figure 2:
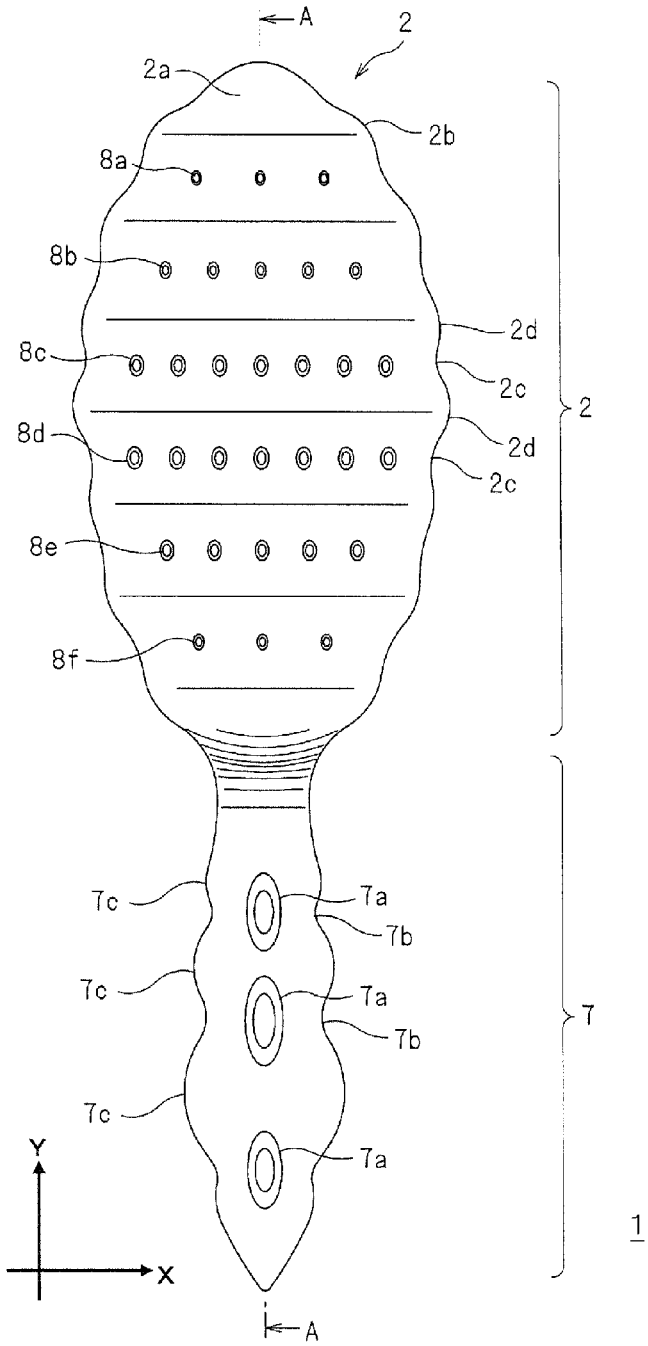
FIG. 2 is a rear view of the hairbrush of Embodiment 1.
Figure 3:
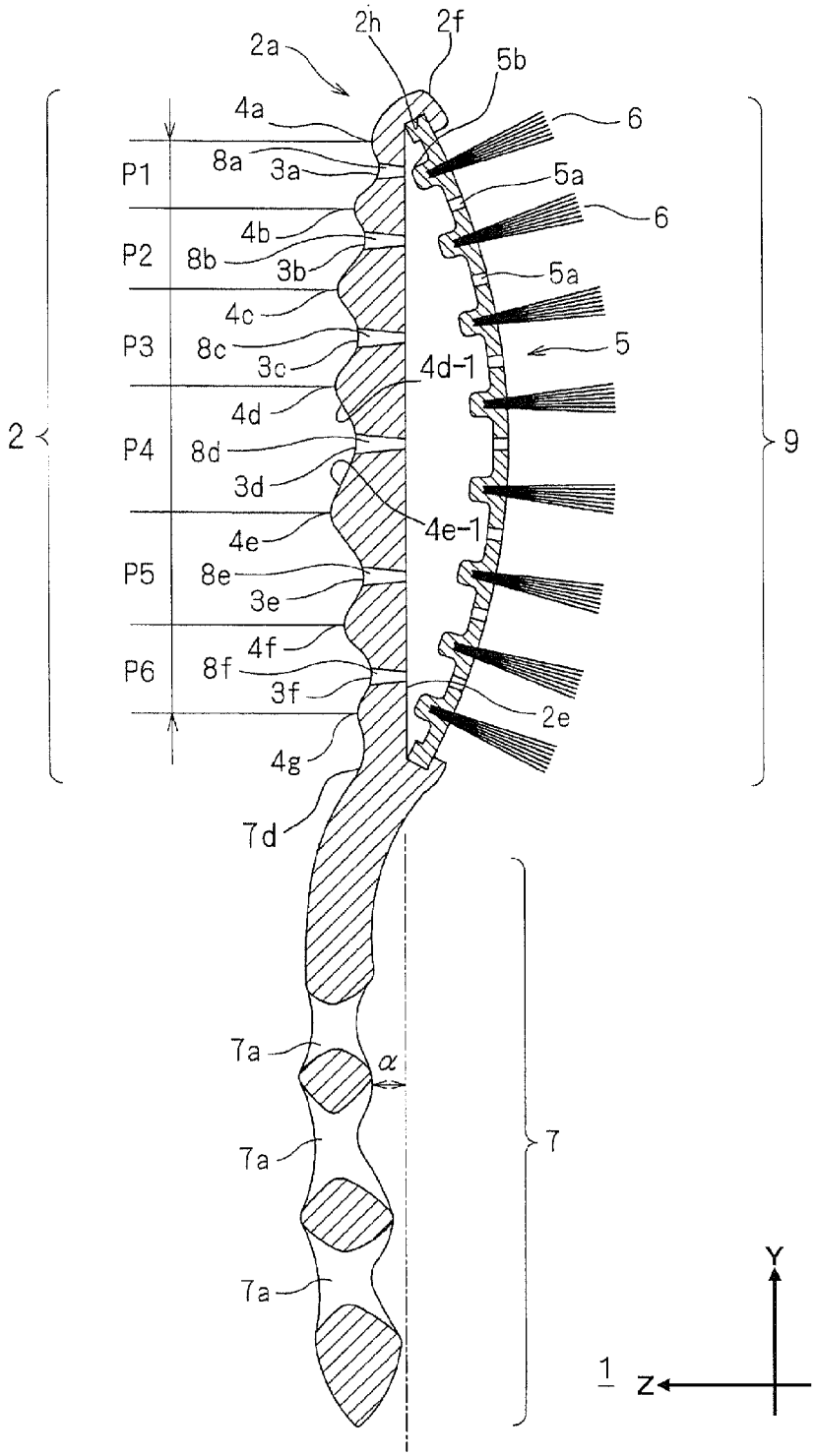
FIG. 3 is a cross-sectional view taken along a line A-A in FIG. 2.

As shown in FIG. 3, the hairbrush 1 has the base part 2 formed with seven projections in total, a first projection 4*a* to a seventh projection 4*g*, on a rear face 2*a* of an ellipsoidal shape (corresponding to the surface on a second side which is opposite to the front face side surface). Each of the projections 4*a* to 4*g* are wide in shape from the top towards the portion of a projection root on the rear face 2, and each of the projections 4*a* to 4*g* is in a shape of continuing in the X-axis direction as shown in FIG. 1(*a*) and FIG. 2. Additionally, since each of the projections 4*a* to 4*g* is formed on the rear face 2*a* of the base part 2 in the Y-axis direction in plural numbers; with respect to the entire rear face of the base part 2, each of the projections 4*a* to 4*g* continuing in the X-axis direction is arranged in a parallel manner in the Y-axis direction at a predetermined interval. Therefore, the rear face 2*a* of the base part 2*a* is formed in a shape of gentle wavy projections and depressions as a whole.

Further, the intervals between the individual projections 4*a* to 4*g* are different depending on the portion in the base part 2. Specifically, as shown in FIG. 3, provided on the portion of the base part 2 on the center side in the Y-axis direction are a fourth projection 4*d* and a fifth projection 4*e*, between which an interval P4 (interval between the tops thereof) is the largest. An interval P3 between a third projection 4*c* and the fourth projection 4*d* as well as an interval P5 between a fifth projection 4*e* and a sixth projection 4*f* are the second largest. An interval P2 between a second projection 4*b* and the third projection 4*c* as well as an interval P6 between the sixth projection 4*f* and a seventh projection 4*g* are the third largest. A first interval P1 between a first projection 4*a* and the second projection 4*b* formed at the portion of the end in the Y-axis is the smallest.

Further, the hairbrush 1 has the base part 2 formed with through-holes 8*a* to 8*f* penetrating thereof at depressed portions 3*a* to 3*f* between the individual projections described above. In detail, the through-hole (e.g., through-hole 8*d*) is formed so as to be opened at the portion (e.g., portion 3*d*) between a slope face (e.g., slope face 4*d*-1) of one of adjacent projections (e.g., fourth projection 4*d*) among the projections and a slope face (e.g., slope face 4*e*-1 opposite to the slope face 4*d*-1) of the other projections (e.g., fifth projection 4*e*).

These through-holes 8*a* to 8*f* are formed in a taper shape so as to decrease gradually in the hole size (inner diameter) from the rear face 2*a* of the base part 2 toward the front face 2*e* to be fitted and fixed with the brush part 9 in a cross-sectional direction in FIG. 3. Further, each of the through-holes 8*a* to 8*f* is formed to have a hole shape (including the shape of the opening) of an ellipsoid as shown in FIG. 2, and as for the direction of the ellipsoidal hole shape of each of the through-holes 8*a* to 8*f*, a longitudinal direction thereof coincides with the longitudinal direction of the base part 2 (Y-axis direction).

Still further, as shown in FIG. 1(*a*) and FIG. 2, the individual through-holes 8*a* to 8*f* are formed at a predetermined interval in the X-axis direction in plural numbers. That is, three through-holes 8*a* in total are formed to be arranged in the X-axis direction between the first projection 4*a* and the second projection 4*b*, and similarly, five through-holes 8*b* in total are formed between the second projection 4*b* and the third projection 4*c*, seven through-holes 8*c* in total are formed between the third projection 4*c* and the fourth projection 4*d*, seven through-holes 8*d* in total are formed between the fourth projection 4*d* and the fifth projection 4*e*, five through-holes 8*e* in total are formed between the fifth projection 4*e* and the sixth projection 4*f*, and three through-holes 8*d* are formed between the sixth projection 4*f* and the seventh projection 4*g*.

In addition, a relative hole size (inner diameter) of the individual through-holes 8*a* to 8*f* depends on the relative interval between the projections corresponding to the portions formed with the holes. That is, the hole size of the through-hole 8*d* is the largest which is formed in the largest interval P4, the hole sizes of the through-holes 8*c* and 8*e* are the second largest which are formed in the second largest intervals P3 and P5, the hole sizes of the through-holes 8*b* and 8*f* are the third largest which are formed in the third largest intervals P2 and P6, and the hole size of the through-hole 8*a* is the smallest which is formed in the smallest interval P1. Therefore, since the through-holes 8*a* to 8*f* of such a hole size are arranged on the rear face 2*a* of the base part 2 in a lattice shape, and the ellipsoidal hole is formed in the direction the same as the circumference shape of the base part 2, the hairbrush 1 according to an aspect of the invention has a configuration where a plurality of through-holes 8*a* to 8*f* are arranged on the rear face 2*a* of a limited area.

Incidentally, as shown in FIG. 1(*b*) and FIG. 3, the base part 2 with the circumference shape of an ellipsoid in the rear face 2*a* and the front face 2*e* has an edge part 2*f* formed in a standing manner on the periphery thereof on the front face 2*e* side on which the brush part 9 is attached, and the inner circumferential side of the edge part 2*f* is depressed to be made a fitting part 2*h* with which the brush part 9 is fitted. Further, as shown in FIG. 2, the base part 2 has the periphery thereof formed in a plurality of trough parts 2*c* and peak parts 2*d* which are curved, which makes design characteristics of the hairbrush 1 with the projections and depressions of the rear face 2*a*, and functions as a slip stopper in a practical aspect where fingers of the user easily enter the curved trough part 2*c* when the user grips the periphery of the base part 2.

Further, the hairbrush 1 has the handle 7, which is protruded from the base part 2, formed with trough parts 7*b* and peak parts 7*c* on the periphery of the handle 7 similarly to the base part 2, which is designed with an image of the entire periphery of the hairbrush 1 being wavy, and functions as a slip stopper as the case of the base part 2. Still further, the hairbrush 1 has the handle 7 formed with three ellipsoidal holes 7*a* in total (hole penetrates through the handle 7), which allow the user's hand gripping the handle 7 to touch the ambient air via the ellipsoidal holes 7*a* to make the user's hand quickly dry which tends to be slippery with sweat or styling spritz (the hand, if dry, is hard to slip). Incidentally, the handle 7, as shown in FIG. 3, is curved at a coupling portion with the base part 2 at the end 7*d* to be offset from the base part 2 by a distance $\alpha$ in the Z-axis direction. With this offset, a distance difference in the Z-axis direction between the user's hand gripping the handle 7 and the brush part 9 fixed to the base part 2 becomes enough, and the hand gripping the handle 7 becomes hard to interfere with the head portion to which the hairbrush 1 is used when using the hairbrush 1.

On the other hand, the brush part 9 fitted with the fitting part 2*h* of the base part 2 shown in FIG. 1(*b*) and FIG. 3 has a configuration where a plurality of bristles 6 are regularly embedded in a cushion member 5 (corresponding to the brush base body) of a curved shape as a part cut from a spherical surface. The cushion member 5 is a member made from a synthetic resin with flexibility, has embedded parts 5*b* of a cup shape formed thereon which is to be embedded with the bristle 6 and protruded inward of the curved shape, and has a plurality of holes 5*a* formed between the individual embedded parts 5*b* to be penetrated through the cushion member 5. Such a brush part 9 is fitted with, at the periphery thereof, the fitting part 2*h* of the base part 2 to complete the hairbrush 1, and a gap between the cushion member 5 of the brush part 9 and the front face 2*e* of the base part 2 is hollow so that the air freely travels therein.

Figure 4:
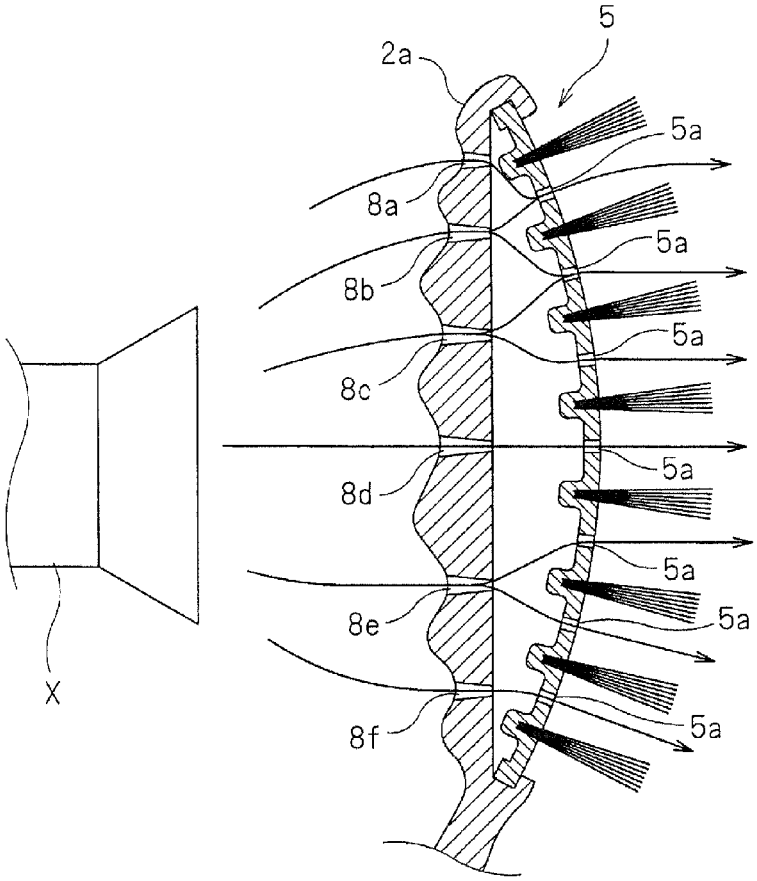
FIG. 4 is a schematic cross-sectional view showing a usage state of the hairbrush of Embodiment 1.

Next, based on FIG. 4, description will be given of a condition where are used the hairbrush 1 of the configuration described above and a hair dryer X. It is assumed that the air from the hair dryer X is blown to the rear face 2*a* of the hairbrush 1 when brushing hair or styling the hair by the hairbrush 1. In this case, the air blown to the rear face 2*a* is rectified by the individual projections 4*a* to 4*g* formed on the rear face 2*a* in plural numbers to naturally be flown into the individual through-holes 8*a* to 8*f* arranged between the slope faces along the individual projections 4*a* to 4*g*, and passes through the base part 2. Incidentally, as shown in FIG. 2, the individual through-holes 8*a* to 8*f* are arranged on the rear face 2*a* in a lattice shape in plural numbers; thus, an amount of air of the hairbrush X passing through the base part 2 can be secured. Further, each of the through-holes 8*a* to 8*f* has, as shown in FIGS. 3 and 4, a taper shape where the hole size decreases toward the front face 2*e* side; thus, as the inner diameter narrows, the wind speed of the air passing through each of the through-holes 8*a* to 8*f* increases so that the air of the hair dryer X is strongly flown out of the individual through-holes 8*a* to 8*f*.

The air flown out of the individual through-holes 8*a* to 8*f* passes through the plural holes 5*a* formed on the cushion member 5 of the brush part 9 so that the air of the hair dryer X reaches the portion of the head hair covered by the hairbrush 1 smoothly and in a large amount compared with the hairbrush formed with the through-holes of related art. Thereby, using the air blown from the hair dryer X, drying of the head hair or setting of the head hair can be done more effectively with the hairbrush 1 according to the aspect of the invention.

Incidentally, the hairbrush 1 according to Embodiment 1 is not limited to the content described above, and various modifications exist. For example, the base part 2 and the handle 7 are molded integrally, but may be configured by coupling separate members. Further, the base part 2 or the handle 7 can be made from a wooden material as materials other than synthetic resin. In the case in which the base part 2 or the handle 7 is made from the wooden material like this, if it is permeated with a coating compound including coal, it can prevent the charge of static electricity and preferably inhibits interference of static electricity while styling hair.

Figure 5:
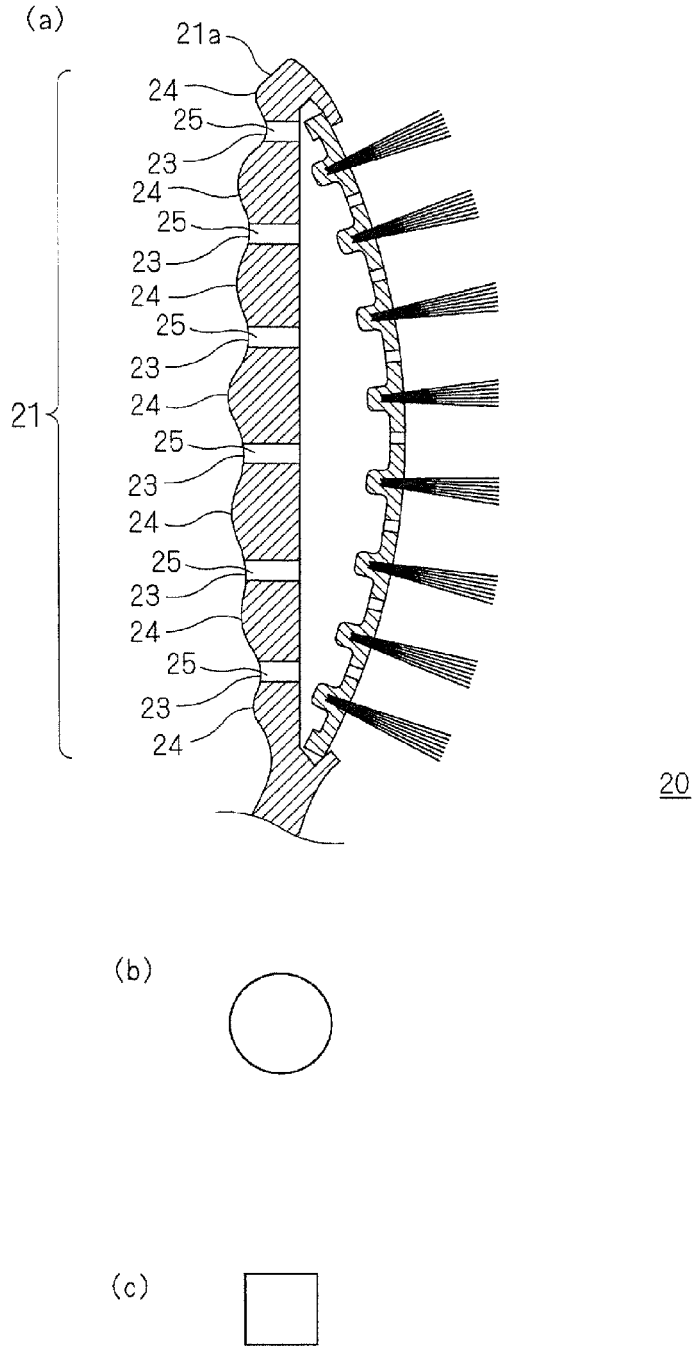
FIG. 5(*a*) is a schematic cross-sectional view showing a modified example where the through-holes are straight holes, FIG. 5(*b*) is a schematic view showing a hole shape of the through-hole of a modified example, and FIG. 5(*c*) is a schematic view showing a hole shape of the through-hole of another modified example.

In addition, the through-holes 8*a* to 8*f* formed on the base part 2 have a taper shape where the hole size decreases from the rear face 2*a* side toward the front face 2*b* side, as well as may have a straight hole where the hole size does not change depending on the target brush size, the thickness of the base part 2 or the like. That is, as shown in a hairbrush 20 of a modified example in FIG. 5(*a*), through-holes 25 which are formed at depressed portions 23 between projections 24 formed on a rear face 21*a* of the base part 21 may be formed in a straight hole. Further, the hole shape (opening shape) of the through-holes 8*a* to 8*f* is not limited to an ellipsoid, but may be formed in, depending on the peripheral shape of the rear face 2*a* of the base part 2, a circle as shown in FIG. 5(*b*), a quadrangle (square) as shown in FIG. 5(*c*), and other polygons. Incidentally, as described above, if the through-hole is formed in a straight hole and the hole shape is formed in a circle, the through-hole can also be formed by a drill.

Additionally, in order for the user's hand gripping the handle not to be exposed to hot air even if the air blown from the hair dryer X is hot air blown from the hair dryer X, there may be considered an air shielding part provided in a protruded condition to a portion of the handle on one end side coupled with the base part or a portion of the base part on the side coupled with the handle.

Figure 6:
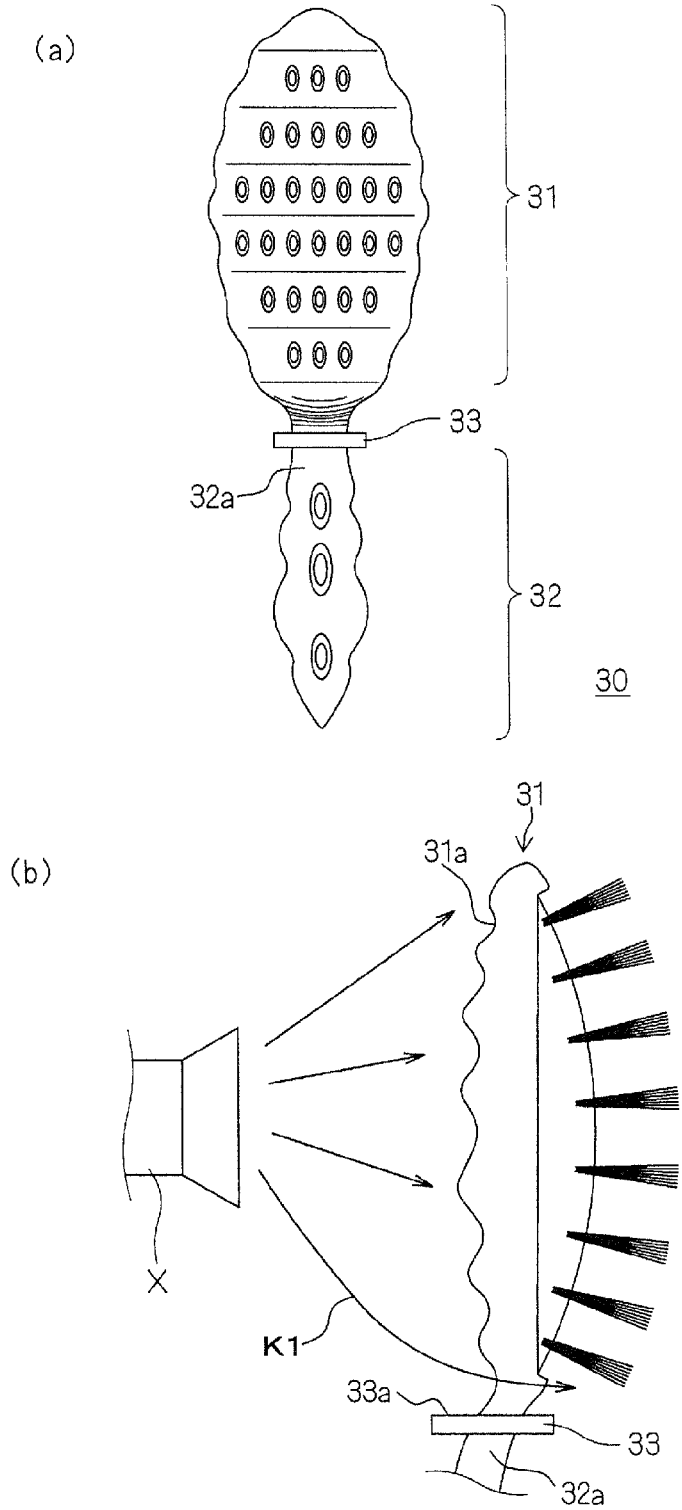
FIG. 6(*a*) is a rear view of a hairbrush of a modified example where an air shielding part is provided, and FIG. 6(*b*) is a schematic view showing a usage state.

FIGS. 6(*a*) and 6(*b*) show a hairbrush 30 of a modified example where a handle 32 is provided with an air shielding part 33 of a flange shape on an end 32*a*. As shown in FIG. 6(*b*), if the air is blown from the hair dryer X to a rear face 31*a* of a base part 31, an air K1 towards the handle 32 is changed in the proceeding direction to a direction of the front face side of the base part 31 by a surface 33*a* of the air shielding part 33 on the base part 31 side. Therefore, the air shielding part 33 plays the role of a heat protector, thereby, the hand gripping the handle 32 is no more exposed to heat of hot air, and the amount of air of the hair dryer flowing to the front face side of the hairbrush 32 can be increased.

Figure 7:
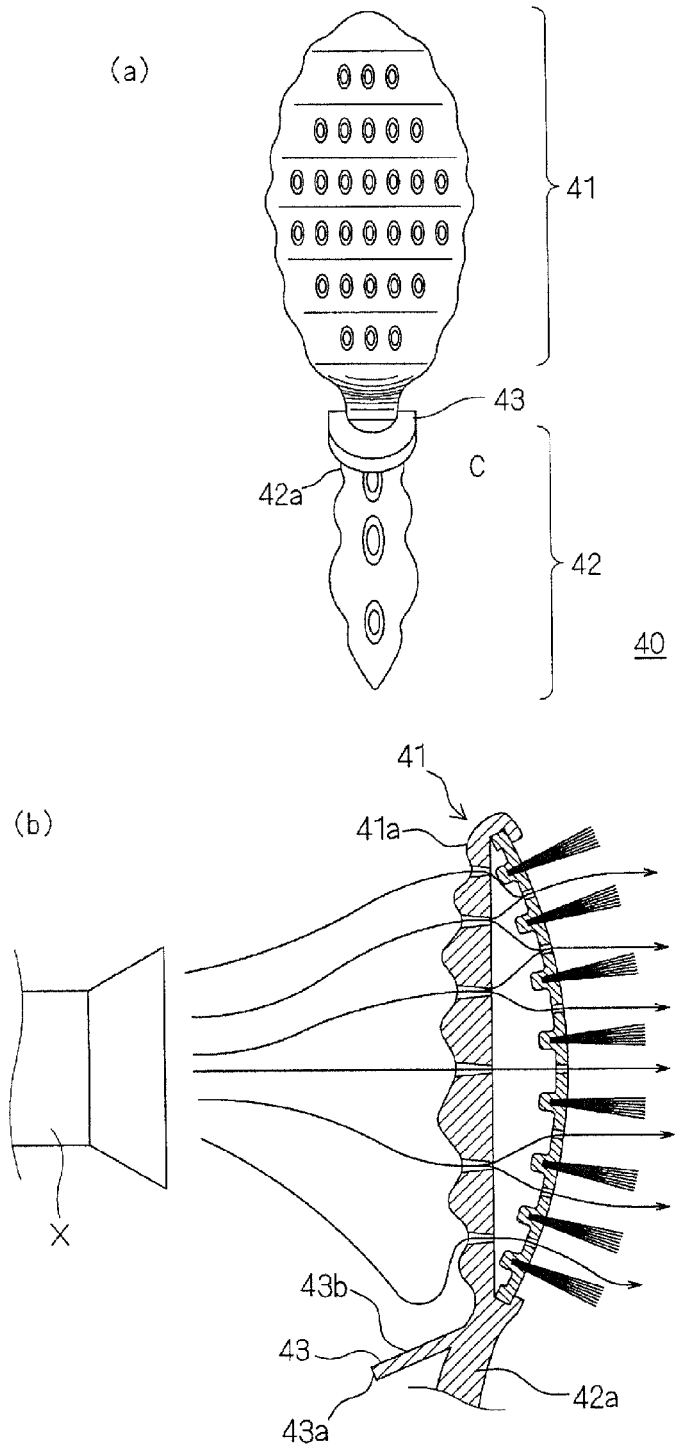
FIG. 7(*a*) is a rear view of a hairbrush of another modified example where an air shielding part is provided, and FIG. 7(*b*) is a schematic view showing a usage state.

FIGS. 7(*a*) and 7(*b*) show a hairbrush 40 of another modified example where an air shielding part is provided in a protruding condition. In the hairbrush 40 of this modified example, the shape and angle of the protruded provision of the air shielding part 43 provided in a protruding condition to an end 42*a* of a handle 42 are made different from those of the air shielding part 33 in FIGS. 6(*a*) and 6(*b*). There are characteristics in which an end part 43*a* of the air shielding part 43 on the side of a rear face 41*a* of a base part 41 is formed so as to entirely be down to the left, that is, downward in FIG. 7(*b*), and so as not to protrude to the front face side of the base part 41. In this modified example, the air shielding part 43, the end part 43*a* is lowered to make a surface 43*b* on the side of the base part 41 inclined, thereby, the air blown from the hair dryer X can be blocked in a wider range compared with the air shielding part 33 in FIGS. 6(*a*) and 6(*b*). Further, the air blocked by the air shielding part 43 is guided to proceed to the rear face 41*a* of the base part 41 to be useful in increasing the amount of air passing through the base part 41.

Figure 8:
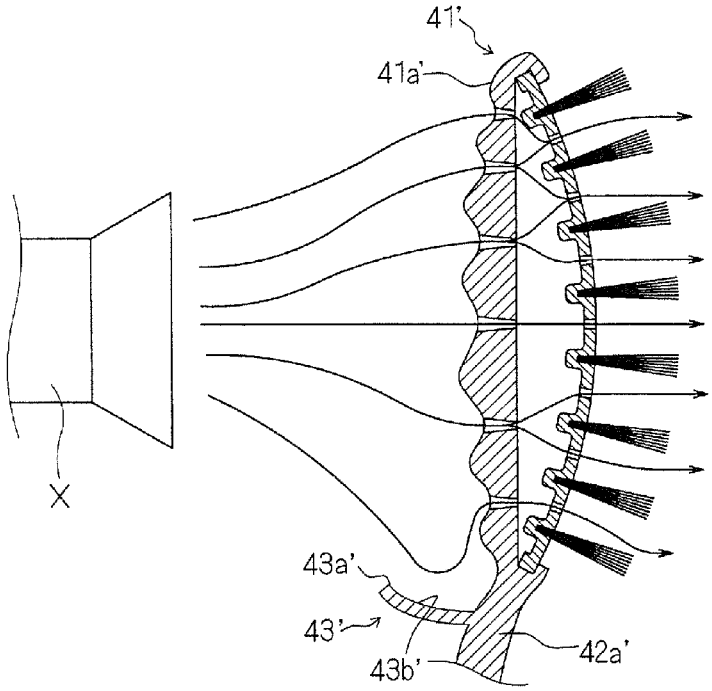
FIG. 8 is a schematic cross-sectional view showing an air shielding part of a modified example.

FIG. 8 shows a hairbrush provided with an air shielding part 43' of still another modified example. There are characteristics in which the air shielding part 43' of this modified example is formed with a different angle from the air shielding part 43 shown in FIG. 7(*b*). Specifically, the air shielding part 43' is formed so that an end part 43*a'* positions above a portion of an end 42*a'* of the handle as a root of protrusion so that a surface 43*b'* is warped back to the rear face 41*a'* side of the base part 41'. With such a shape, in the air shielding part 43' of the modified example, the angle range to block the air from the hair dryer X is widened to fully protect the user's hand gripping the handle from the hot air. Incidentally, there are shown cases where the air shielding parts 33, 43 and 43' in FIGS. 6 to 8 are provided to the ends 32*a*, 42*a* and 42*a'* of the handles 32 and 42; however, the air shielding parts 33, 43 and 43' may also be provided to portions continuing to the handles 32 and 42 of the base parts 31, 41 and 41'.

Figure 9:
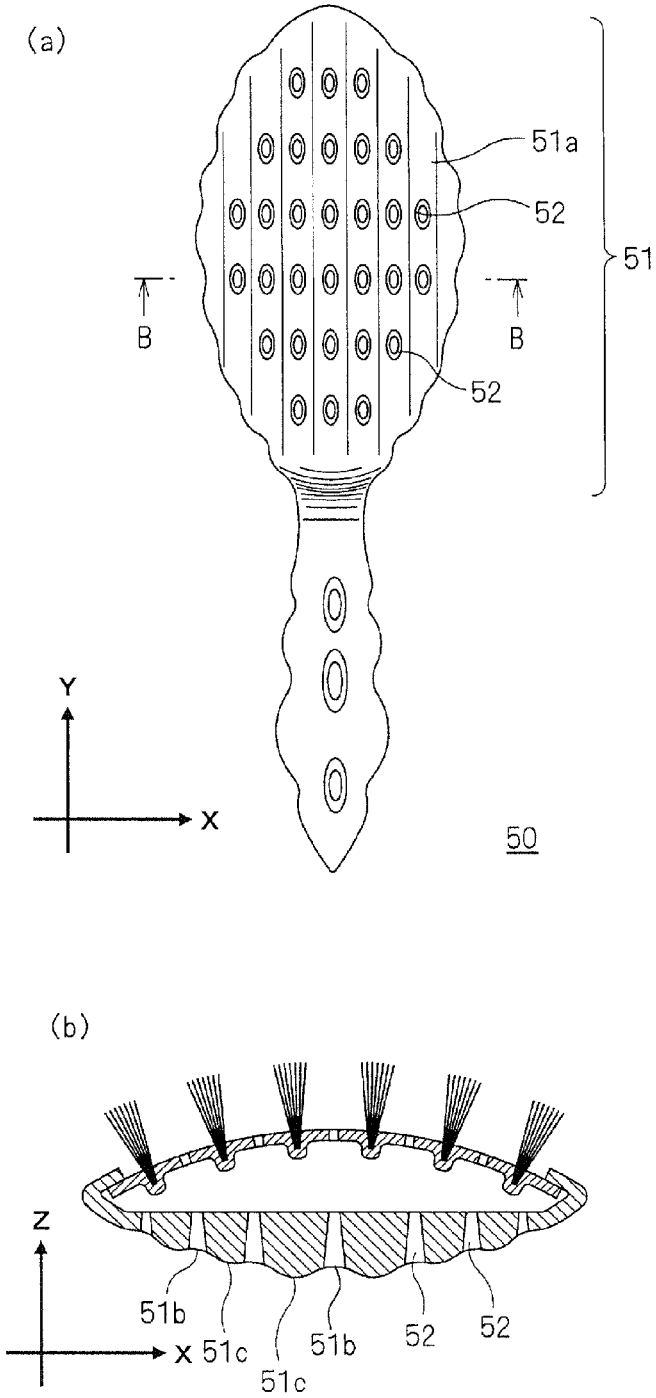
FIG. 9(*a*) is a rear view of a hairbrush of a modified example provided with a plurality of protrusions of a shape continuing in the Y-axis direction, and FIG. 9(*b*) is a cross-sectional view taken along a line B-B in FIG. 9(*a*).

Additionally, a hairbrush 50 in FIGS. 9(*a*) and 9(*b*) shows a modified example where the direction of individual projections 51*c* continuing is set to not the X-axis direction, but the Y-axis direction. That is, in the hairbrush 50 of the modified example, the projections 51*c* continue along the Y-axis direction, and the plural projections 51*c* are arranged in the X-axis direction at an interval in a parallel manner. Further, the through-holes 52 formed at the depressed portions 51*b* between the individual projections 51*c* are formed in an ellipsoidal shape with the longitudinal direction thereof being set to the Y-axis direction, and thereby, fits regularly between the projections continuing in the Y-axis direction, allowing a number of through-holes 52 to be arranged.

Figure 10:
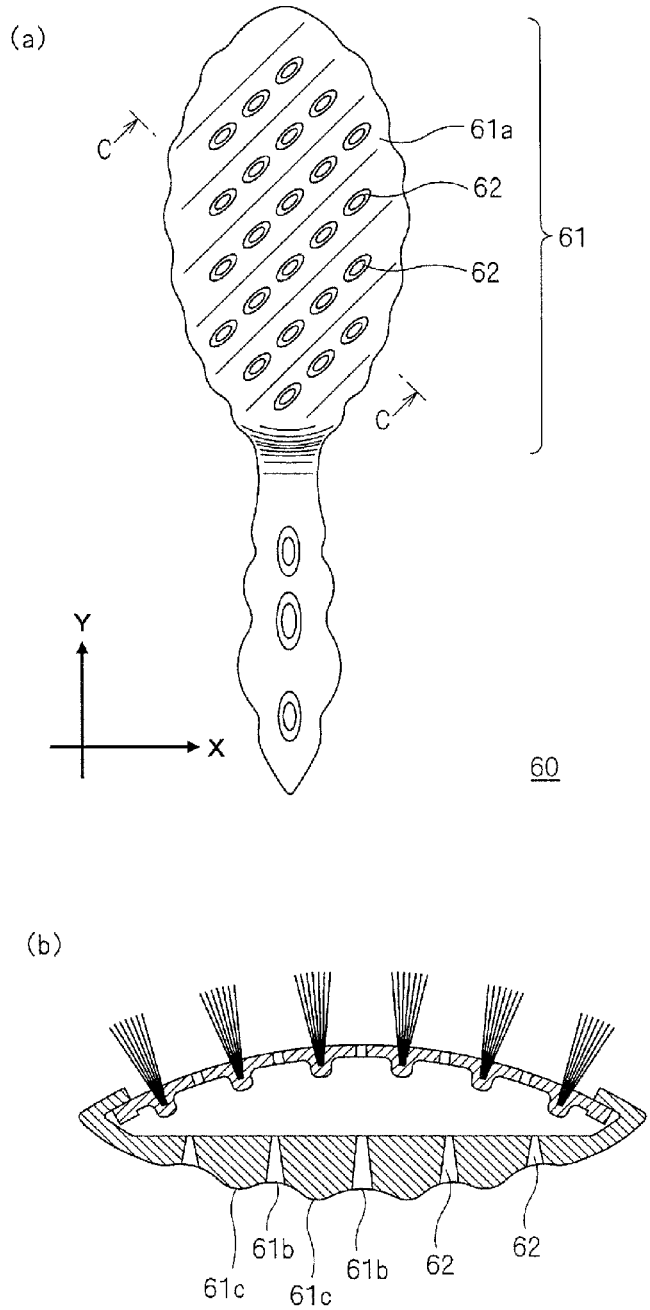
FIG. 10(*a*) is a rear view of a hairbrush of a modified example provided with a plurality of protrusions of a shape continuing in a direction obliquely to the X-axis direction or the Y-axis direction, and FIG. 10(*b*) is a cross-sectional view taken along a line C-C in FIG. 10(*a*).

Further, a hairbrush 60 in FIGS. 10(*a*) and 10(*b*) shows a modified example where the direction of individual projections 61*c* continuing is set to not the X-axis nor the Y-axis direction, but the direction between the X-axis and the Y-axis directions (e.g., a direction at about a 45 degrees angle obliquely to the X-axis direction). In the hairbrush 60 of this modified example, the projections 61*c* continue in the oblique direction relative to the X-axis, and the plural projections 61*c* are arranged in a direction perpendicular to the projections 61*c* continuing direction at an interval in a parallel manner. Additionally, through-holes 62 formed at depressed portions 61*b* between the individual projections 61*c* are also formed in an ellipsoidal shape with the longitudinal direction thereof being set to the projections 61*c* continuing direction, thereby increasing the number of the through-holes 62 arranged. Incidentally, in FIG. 10(*a*), the projections 61*c* continuing direction is higher on the right, but may be lower on the right as well.

Figure 11:
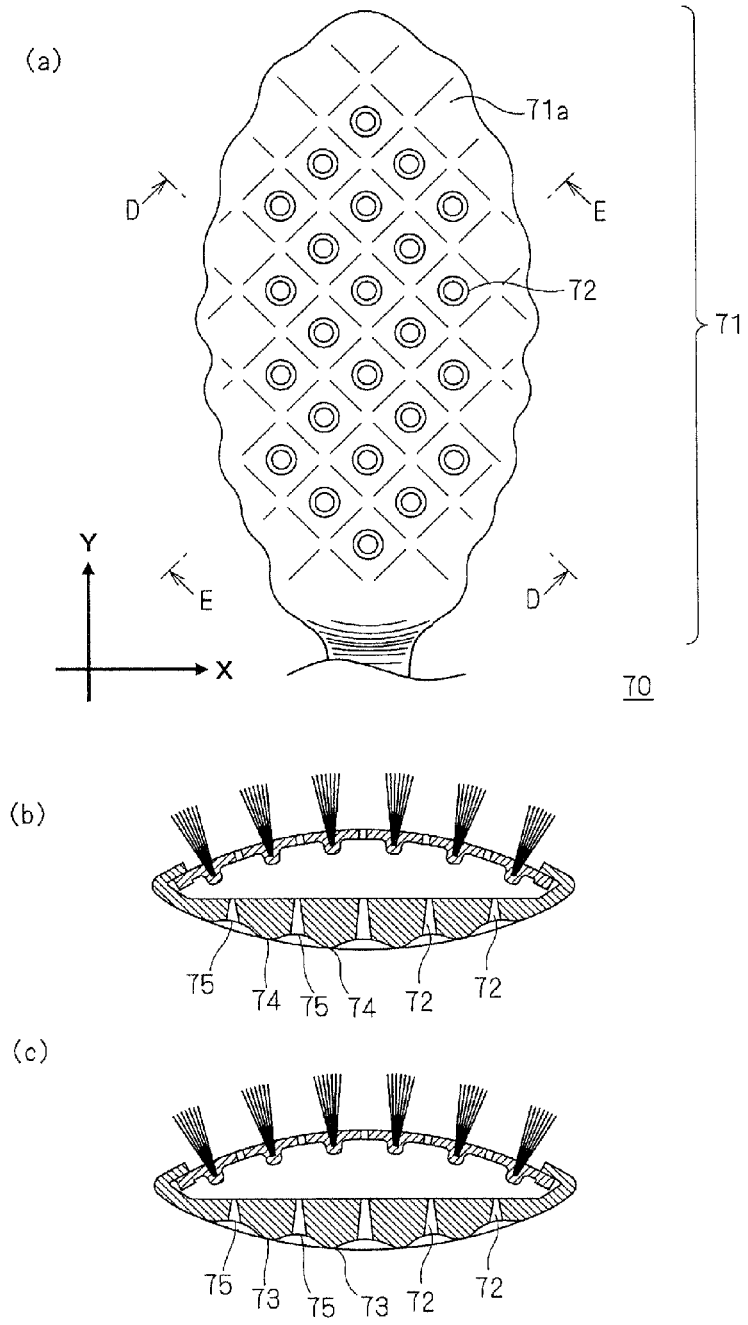
FIG. 11(*a*) is a rear view of a hairbrush of a modified example provided with a plurality of protrusions so as to cross with each other, FIG. 11(*b*) is a cross-sectional view taken along a line D-D in FIG. 11(*a*), and FIG. 11(*c*) is a cross-sectional view taken along a line E-E in FIG. 11(*a*).

Further, a hairbrush 70 of FIGS. 11(*a*) to 11(*c*) shows a modified example where formed on a rear face 71*a* of a base part 71 are two kinds of projections 73 and 74 which continue in two directions respectively. The direction of the projections 74 of one kind thereof to continue is set to the direction between the X-axis and the Y-axis directions (e.g., a direction at about a 45 degrees angle obliquely to the X-axis direction), and a direction of the projections 74 of the other kind to continue is set to be perpendicular to the projections 73 continuing direction of the first kind thereof. Further, in the hairbrush 60, through-holes 72 are formed at a depressed portion 75 between the individual projections 73 and 74. Therefore, each of the through-holes 72 is surrounded by the projections 73 and 74 all over the periphery so that the air of the hair dryer flows in from all periphery directions, allowing a much larger amount of air to be sent into the front face side of the hairbrush 70. Incidentally, since in FIGS. 11(*a*) to 11(*c*) the air is flown from all the periphery directions, the hole shape (opening shape) of the through-holes 72 are fowled in a circle, but other shapes (ellipsoid, polygon) described above may be used as well. In addition, the individual projections 73 and 74 may be formed so as to continue not in the oblique direction relative to the X-axis and the Y-axis, but in a direction along the X-axis and the Y-axis.

Figure 12:
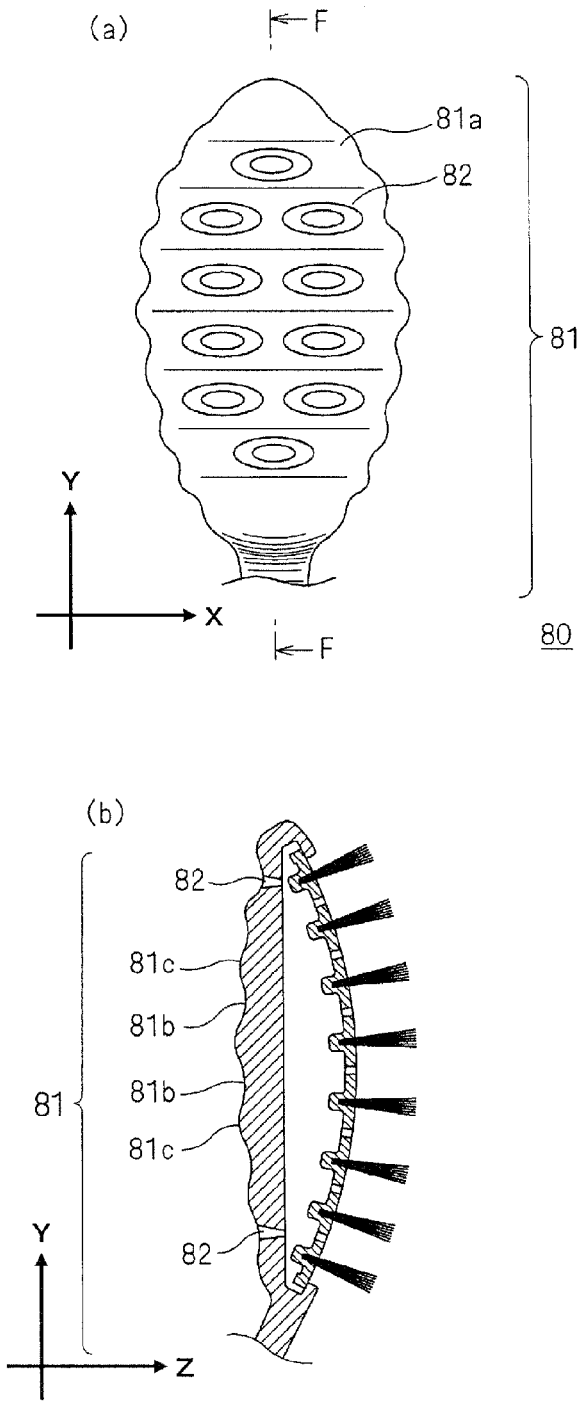
FIG. 12(*a*) is a rear view of a hairbrush of a modified example formed with through-holes, a longitudinal direction of which is arranged in the X-axis direction, and FIG. 12(*b*) is a cross-sectional view taken along a line F-F in FIG. 12(*a*).

Further, FIGS. 12(*a*) and 12(*b*) show a hairbrush 80 of another modified example. Projections 81*c* formed on a rear face 81*a* of a base part 81 are formed similarly to the projections 4*a* to 4*g* of the hairbrush 1 shown in FIGS. 1 to 4; however, the shape of through-holes 82 formed at depressed portions 81*b* between the individual projections 81*c* is made different from the through-holes 8*a* to 8*f* the hairbrush 1 shown in FIGS. 1 to 4. That is, the through-holes 82 according to the hairbrush 80 of the modified example with the hole shape and opening shape being an ellipsoid has characteristics in which the longitudinal direction of the ellipsoid is set to the X-axis direction. With this configuration, in the hairbrush 80, the through-holes 82 can be formed between the projections 81*a* with a large opening area and the air amount passing through each one of the through-holes 82 is increased to send the air of the hair dryer to the front face side.

Figure 13:
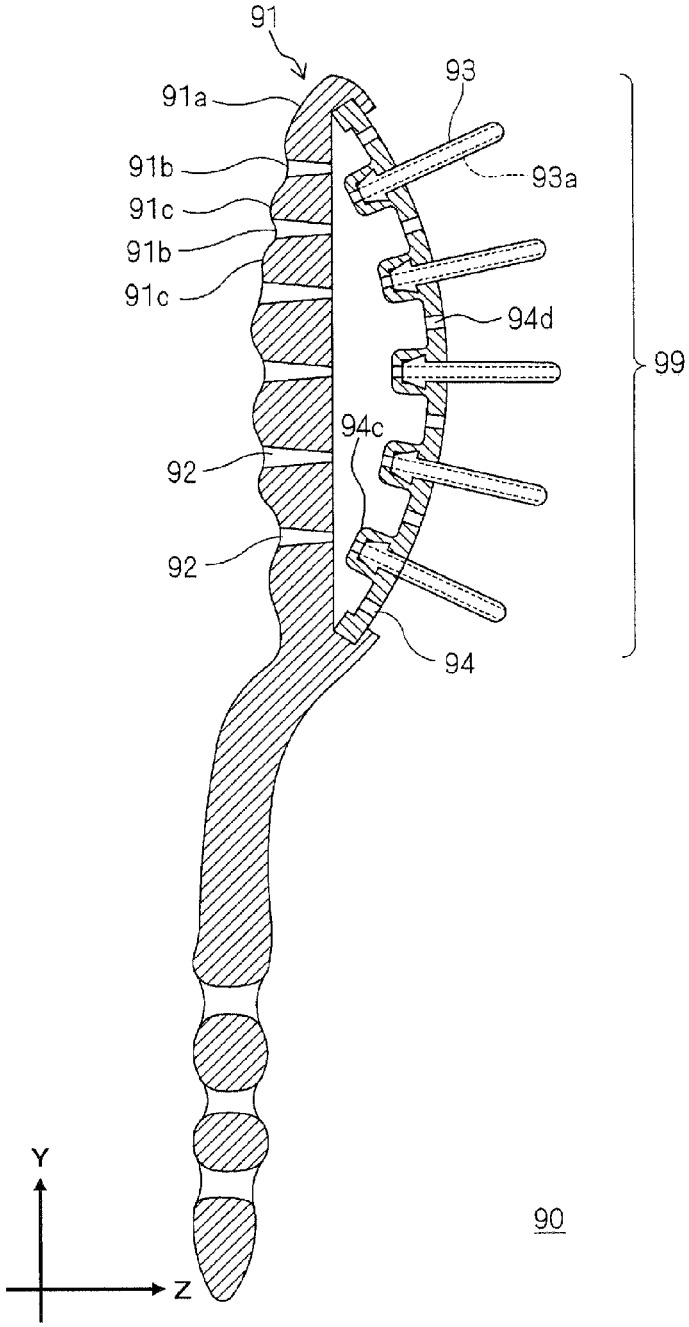
FIG. 13 is a cross-sectional view of a hairbrush of a modified example having brush pins respectively formed with a pin bore.

Additionally, a hairbrush 90 of a modified example shown in FIG. 13 is a type in which provided to the brush part is not the bristle but a brush pin 93, and a plurality of brush pins 93 are embedded in a brush base body 94 (cushion member) of a brush part 99. The modified embodiment has characteristics in which each of the brush pins 93 has a pin bore 93*a* formed therein, and in an embedded part 94*c* of the brush pin 93 of the brush base body 94, communicating holes 94*b* (refer to FIGS. 14(*a*) and 14(*b*)) are formed.

Figure 14:
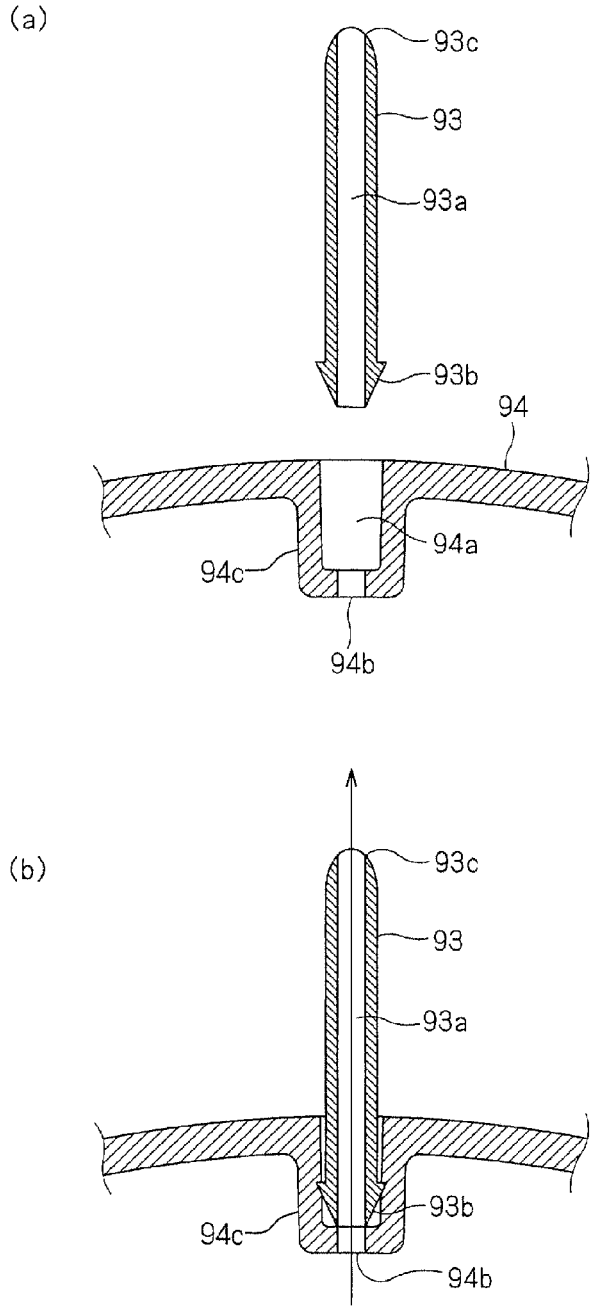
FIG. 14(*a*) is a schematic cross-sectional view showing a state where brush pins are embedded, and FIG. 14(*b*) is a schematic cross-sectional view showing the state where brush pins are embedded.

Specifically, as also shown in FIGS. 14(*a*) and 14(*b*), the brush pin 93 has an engaging part 93*b* formed in a protruding condition on the end on an embedded side, a tip end part 93*c* formed in a semispherical shape, and further, the pin bore 93*a* formed to penetrate through the pin along the direction of a pin axis. Incidentally, as for material of such a brush pin 93, wood is used.

On the other hand, the brush base body 94 has communicating holes 94 formed on the bottom of the embedded part 94*c* of a cup shape. As shown in FIGS. 14(*a*) and 14(*b*), if the engaging part 93*b* of the brush pin 93 is embedded in a space part 94*a* inside the embedded part 94*c* to be fixed and engaged thereto, the communicating holes 94 of the embedded part 94*c* communicates with the pin bore 93*a* of the brush pin 93. Incidentally, the hairbrush 90 of the modified example is equivalent to the hairbrush 1 shown in FIGS. 1 to 4 except for the portions described above, and as shown in FIG. 13, a plurality of projections 91*c* are formed on a rear face 91*a* of a base part 91, through-holes 92 are formed at depressed portions 91*b* between projections 91*c*, and holes 94*d* are formed at the brush base body 94 of a brush part 99.

When the air of the hair dryer is blown to the hairbrush 90 on the rear face 91*a* side of the modified example like this, in addition to the flow of air as shown in FIG. 4, formed is the flow of air where the air flowed out from the through-hole 92 of the base part 91 passes through the communicating holes 94*b* formed to the embedded part 94*c* of the brush base body 94 and the pin bores 93*a* of the brush pins 93 to be blown out from the tip end parts 93*c* of the brush pins 93. Therefore, in the hairbrush 90 of the modified example, on the front face side provided with the brush part 99, the total area of the openings from which the air is blown can be made larger than the hairbrush 1 shown in FIGS. 1 to 4, as well as, since the air is also blown from the tip end parts 93*c* of the brush pins 93, brushing, styling hair or the like can be conducted using a nonconventional flow of air.

Figure 15:
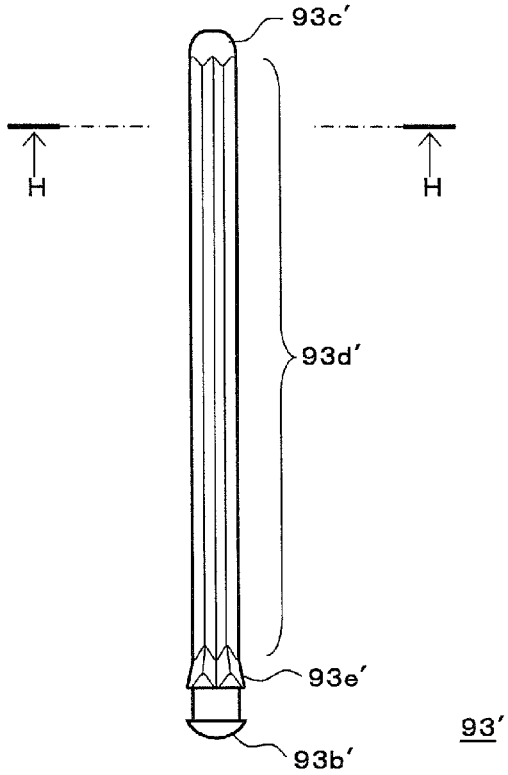
FIG. 15(*a*) is a front view of a brush pin of a modified example, and FIG. 15(*b*) is a cross-sectional view taken along a line H-H in FIG. 15(*a*).
Figure 15:
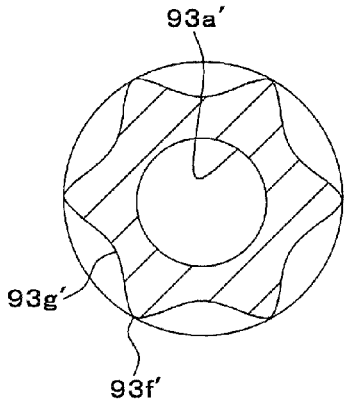

A brush pin 93' shown in FIGS. 15(*a*) and 15(*b*) is a modified example of the brush pin 93 shown in FIG. 13 and FIGS. 14(*a*) and 14(*b*), and can be used in place of the brush pin 93 in the hairbrush 90 in FIG. 13. The brush pin 93' has a flare part 93*e'* provided in a protruding condition which contacts with the surface of the brush base body 94, to prevent the brush pin from being subducted, at a little interval from an engaging part 93*b'* provided at the end on a side of the brush pin 93' to be embedded. A portion in the range from this flare part 93*e'* to the tip end part 93*c'* of a semispherical shape has a cross-section (an outer circumference shape of a cross section in a direction perpendicular to the longitudinal direction of the pin) of a star shape as shown in FIG. 15(*b*). Incidentally, a pin bore 93*a'* penetrating through the pin along the pin axis direction is also formed in the brush pin 93'. Additionally, a distance from the end on the engaging part 93*b'* side to the flare part 93*e'* is set to the size equal to or shorter than the depth size of the space part 94*a* of the embedded part 94*c* in the brush base body 94 shown in FIG. 14(*a*) so that the tip end of the flare part 93*e'* is engaged with an opening periphery of the space part 94*a* of the brush base body 94.

With the brush pin 93' of such a modified example being used, in addition to the air of the hair dryer being blown out from the tip end part 93*c'*, when brushing or styling hair by use of the hairbrush, a space is generated between a depression 93*g'* of the star-shaped cross section shown in FIG. 15(*b*) and the hair, through which the air discharged out from the hole part 94*d* (refer to FIG. 13) of the brush base body 94 passes, allowing quick drying of the hair and the like. Further, when brushing or styling hair by use of the hairbrush, a protruding peak part 93*f'* of the star cross-section shape of the brush pin 93' contacts linearly with the hair epidermis (cuticle); thereby, the contact pressure with the hair increases to easily gloss the hair compared with the brush pin 93 shown in FIG. 13 and the like.

Incidentally, the brush pin 93' shown in FIGS. 15(*a*) and 15(*b*) may have a cross-section of a polygon (triangle, quadrangle, pentagon, etc.), a cross or the like other than the star shape. Additionally, the brush pins 93 and 93' may be molded with a synthetic resin in addition to using wood as the material as well, and may be formed from a carbon fiber in order to prevent the charge of static electricity. Further, when the air blown from the pin tip end is not needed, formation of the pin bores 93*a* and 93*a'* may be omitted.

In addition, in Embodiment 1, the various modified examples are explained as described above, the respective modified examples may be, if possible, combined, and the combination of these examples make it possible to send further efficiently the air of the hair dryer to the front face side of the hairbrush. Additionally, depending on the size, shape and the like of the hairbrush, there may not be employed interval sizes between the individual projections 4*a* to 4*g* made different from one another, nor the hole sizes of the individual through-holes 8*a* to 8*f* made different from one another, as shown in FIG. 3, and these sizes may be the same, respectively.

Embodiment 2

Figure 16:
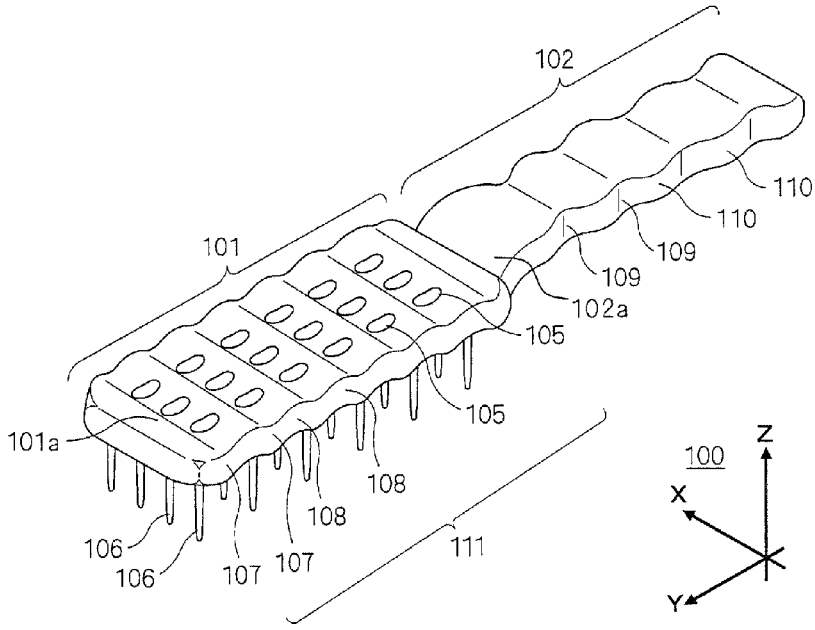
FIG. 16 is a perspective view of a hairbrush according to Embodiment 2 of the invention.
Figure 17:
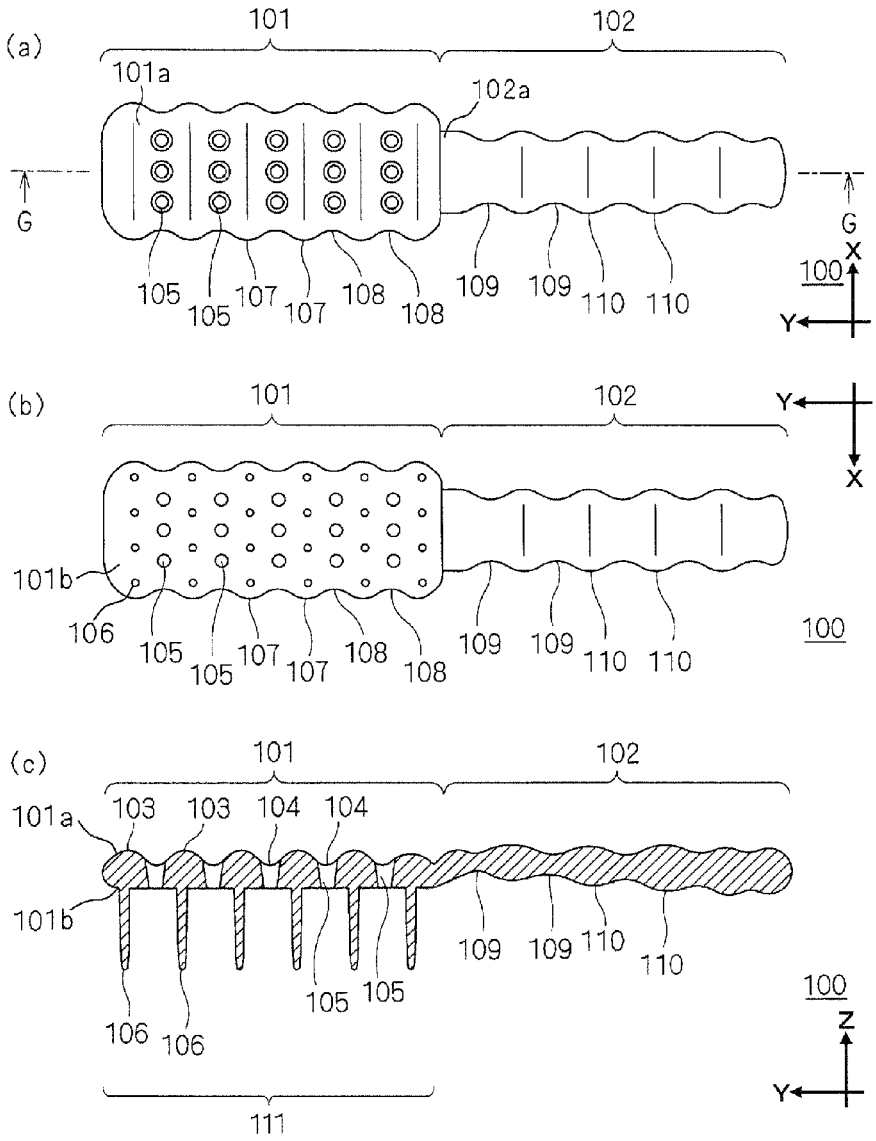
FIG. 17(*a*) is a rear view of the hairbrush of Embodiment 2, FIG. 17(*b*) is a front view, and FIG. 17(*c*) is a cross-sectional view taken along a line G-G in FIG. 17(*a*).

FIG. 16 and FIGS. 17(*a*) to 17(*c*) show a hairbrush 100 according to Embodiment 2 of the invention. The hairbrush 100 according to Embodiment 2 is an integrally molded product of a synthetic resin, and has a configuration where a brush part 111 including a plurality of brush pins 106 is directly provided to a base part 101 provided to an end 102*a* of a handle 102. In the hairbrush 100, the handle 102 has a periphery thereof formed in depressions 109 and projections 110 in a curved shape, and also the base part 101 has a periphery thereof formed in depressions 108 and projections 107 in a curved shape, making apparent design characteristics.

In addition, as shown in FIGS. 17(*a*) and 17(*c*), in the hairbrush 100, projections 103 having a shape of continuing in the X-axis direction are formed on a rear face 101*a* of the base part 101 in the Y-axis direction in plural numbers so that the plural projections 103 are arranged in a parallel manner as a whole. Incidentally, as shown in FIG. 17(*c*), the shape of the projections 103 is base-diverging from the top towards the protruding side. Further, the hairbrush 100 has the base part 101 formed with through-holes 105 penetrating thereof at depressed portions 104 between opposite slope faces of the projections 103 adjacent to each other. Incidentally, the through-holes 105 are formed in taper shape similarly to the hairbrush 1 of Embodiment 1 according to FIGS. 1 to 4, and formed between the individual projections 103 at a predetermined interval in the X-axis direction in plural numbers. Further, the hairbrush 100 has the brush part 111 which is formed with the plural brush pins 106 in a protruding condition from a surface 101*b* of the base part 101.

Also in such a hairbrush 100 according to Embodiment 2, if the air of the hair dryer is blown from the rear face 101*a*, the air is guided to the depressed portion 104 between the projections 103 to pass through the through-hole 105, and the air is flown through to the front face 101*b*. Therefore, even when the hairbrush 100 is used for brushing or styling hair, enough amounts of air can be sent to a portion of the head hair covered by the hairbrush 100. In addition, the hairbrush 100 according to Embodiment 2 can be molded integrally, which is a configuration preferable for mass production. Incidentally, in the hairbrush 100 according to Embodiment 2, the applicable contents in the various modified examples described in Embodiment 1 may be adequately used.

INDUSTRIAL APPLICABILITY

The air from a hair dryer is guided to through holes formed between a plurality of projections to efficiently send an enough amount of air to a portion of head hair covered by a hairbrush. Therefore, it is possible to enhance a work efficiency according to styling hair in a hairdressing field, a cosmetic field or the like.

The invention claimed is:

1. A hairbrush comprising a handle, a base part provided at an end of the handle, and a brush part provided on a face of a first side of the base part, a plurality of projections of a base-diverging shape are formed on a face of a second side that is opposite from the first side, and at least one through-hole is formed so as to penetrate the base part, so that air passed through the through-hole from the second side is flown through to a front face of the brush part, wherein the through-hole is formed so as to open at a bottom portion between opposing slope faces of the adjacent projections of the plurality of projections, so that air is guided to the through-hole owing to the opposing slope faces.

2. The hairbrush of claim 1, wherein the through-hole is formed such that a hole size thereof becomes smaller from the second side towards the first side.

3. The hairbrush of claim 1, wherein the projections are formed continuously in one direction on the face of the second side, and a plurality of through-holes are formed at a predetermined interval in a direction parallel to the direction of the projections continuously arranged.

4. The hairbrush of claim 2, wherein the projections are formed continuously in one direction on the face of the second side, and a plurality of through-holes are formed at a predetermined interval in a direction parallel to the direction of the projections continuously arranged.

5. The hairbrush of claim 3, wherein the plurality of projections continuously formed in the one direction are arranged in parallel to each other.

6. The hairbrush of claim 4, wherein the plurality of projections continuously formed in the one direction are arranged in parallel to each other.

7. The hairbrush of claim 5, wherein the projections includes at least four projections, wherein an interval between the projections on the center side is made larger than an interval between the projections on the end sides in a direction perpendicular to the one direction, and wherein each size of the through-holes located on the center side is made larger than each size of the through-holes located on the end sides.

8. The hairbrush of claim 6, wherein the projections includes at least four projections, wherein an interval between the projections on the center side is made larger than an interval between the projections on the end sides in a direction perpendicular to the one direction, and wherein each size of the through-holes located on the center side is made larger than each size of the through-holes located on the end sides.

9. The hairbrush of claim 1, wherein a peripheral shape of the base part has an ellipsoidal shape on the face of the second side, and wherein a hole shape of the through-hole is made ellipsoidal, and a longitudinal direction of the base part is coincided with the longitudinal direction of the hole shape.

10. The hairbrush of claim 1, wherein the brush part includes a brush base body having a plurality of bristles or brush pins, and wherein at least one hole is formed so as to penetrate the brush base body.

11. The hairbrush of claim 2, wherein the brush part includes a brush base body having a plurality of bristles or brush pins, and wherein at least one hole is formed so as to penetrate the brush base body.

12. The hairbrush of claim 3, wherein the brush part includes a brush base body having a plurality of bristles or brush pins, and wherein at least one hole is formed so as to penetrate the brush base body.

13. The hairbrush of claim 4, wherein the brush part includes a brush base body having a plurality of bristles or brush pins, and wherein at least one hole is formed so as to penetrate the brush base body.

14. The hairbrush of claim 8, wherein the brush part includes a brush base body having a plurality of bristles or brush pins, and wherein at least one hole is formed so as to penetrate the brush base body.

15. The hairbrush of claim 9, wherein the brush part includes a brush base body having a plurality of bristles or brush pins, and wherein at least one hole is formed so as to penetrate the brush base body.

16. The hairbrush of claim 10, wherein the brush pin is embedded in the brush base body, and is formed with a pin bore so as to penetrate therethrough in a pin axis direction, and wherein a portion of the brush base body embedded with the brush pin has a communicating hole formed which communicates with the pin bore.

17. The hairbrush of claim 1, wherein an air shielding part is protruded either on a portion of the end of the handle or on a portion of the base part on the side coupled with the handle, the air shielding part being formed so as to prevent wind blown to the face of the second side from flowing to the handle.

18. The hairbrush of claim 2, wherein an air shielding part is protruded either on a portion of the end of the handle or on a portion of the base part on the side coupled with the handle, the air shielding part being formed so as to prevent wind blown to the face of the second side from flowing to the handle.

19. The hairbrush of claim 3, wherein an air shielding part is protruded either on a portion of the end of the handle or on a portion of the base part on the side coupled with the handle, the air shielding part being formed so as to prevent wind blown to the face of the second side from flowing to the handle.

20. The hairbrush of claim 5, wherein an air shielding part is protruded either on a portion of the end of the handle or on a portion of the base part on the side coupled with the handle, the air shielding part being formed so as to prevent wind blown to the face of the second side from flowing to the handle.

* * * * *